United States Patent [19]

Bartenbach

[11] Patent Number: 4,794,501

[45] Date of Patent: Dec. 27, 1988

[54] INDIRECT SPECULAR LAMP

[75] Inventor: Christian Bartenbach, Munich, Fed. Rep. of Germany

[73] Assignee: Siemens Aktiengesellschaft, Berlin and Munich, Fed. Rep. of Germany

[21] Appl. No.: 863,182

[22] Filed: May 14, 1986

[30] Foreign Application Priority Data

May 17, 1985 [DE] Fed. Rep. of Germany ..... 3517897

[51] Int. Cl.[4] ..... F21J 7/00

[52] U.S. Cl. ..... 362/298; 362/217; 362/260; 362/290

[58] Field of Search ..... 362/217, 257, 260, 290, 362/298

[56] References Cited

U.S. PATENT DOCUMENTS

| | | | |
|---|---|---|---|
| 2,219,383 | 10/1940 | Dillon | 362/219 |
| 3,671,735 | 6/1972 | King | 240/41.1 |
| 4,006,355 | 2/1977 | Shemitz et al. | 362/290 X |
| 4,310,876 | 1/1982 | Small et al. | 362/298 |
| 4,414,609 | 11/1983 | Shemitz | 362/33 |

FOREIGN PATENT DOCUMENTS

| | | |
|---|---|---|
| 2420022 | 11/1975 | Fed. Rep. of Germany . |
| 3440028 | 5/1985 | Fed. Rep. of Germany . |

OTHER PUBLICATIONS

"Objektleuchten" of Siemens AG, Catalog I 4.23, 1982, p. 3/0.

*Primary Examiner*—Margaret A. Focarino

*Attorney, Agent, or Firm*—Hill, Van Santen, Steadman & Simpson

[57] ABSTRACT

The specular lamp or lighting fixture comprises a fluorescent tube as a light bulb which is arranged largely within a channel-shaped counter-reflector. Cross-lamellae for blanking the light of the fluorescent tube out in the longitudinal direction are seated on the counter-reflector. A channel-shaped main reflector which is designed large, and whose surface is preferably matted, is situated opposite the counter-reflector. A uniform luminance in the radiation region and a compact structure are achieved with the specular lamp. The luminance does not exceed a prescribed value in a prescribed, screened region.

11 Claims, 1 Drawing Sheet

INDIRECT SPECULAR LAMP

BACKGROUND OF THE INVENTION

The invention relates to an indirect specular lamp comprising a counter-reflector, a lamp arranged within the counter-reflector and completely shielded therefrom, and an at least partially curved main reflector arranged opposite the counter-reflector and fashioned larger than the counter-reflector.

In lighting technology, there is an effect to protect a person situated at a certain distance from the lamp against being dazzled. This person should thus not have a direct view of the lamp and should not be disturbed by glaring reflectors. An adequate brightness should also be established for the intended purpose in the beam region of the lamp. These conditions are satisfactorily met by a specular lamp of the type initially cited which is disclosed, for example, in the product brochure "Objektleuchten" of Siemens AG, Catalog I 4.23 1982, page 3/0, incorporated herein. An indirect specular lamp comprising a halogen lamp within a counter-reflector or back-reflector is shown therein. This arrangement is situated opposite a main reflector from which the light rays are reflected into the region to be illuminated. Above a screening angle—measured from the vertical—the lamp has a screening region in which no light is beamed out from the main reflector. Given a viewing angle which is smaller than the screening angle (radiation range), the lamp itself is covered by the counter-reflector or back-reflector.

There have been recent efforts to also achieve a low luminance in the radiation range. One reason for this is that, given reflective work surfaces, for example, that reside under the lamp, a person working there will not be disturbed by an excessively great luminance when looking at the reflective work surface.

Specular lamps of the known type only have a low luminous flux. In order to uniformly illuminate larger spaces, several of these illuminating devices are required, this not always being economically justifiable.

SUMMARY OF THE INVENTION

An object of the invention is to create a specular lamp of the type initially cited having a higher luminous flux wherein the luminance in the radiation range does not exceed a prescribed value.

This object is achieved in accordance with the invention in that the light bulb is a fluorescent tube, that the counter-reflector is fashioned channel-like, and is provided with cross-lamellae for blocking off the light bulb in the longitudinal direction.

The desired, high luminous flux is assured by the use of the fluorescent bulb. The cross-lamellae at the counter-reflector guarantee that the luminance in the radiation region is also low when observed in the longitudinal direction.

An especially advantageous development of the invention is that the main reflector—as seen in cross section—is formed of two circular arc parts joined to one another, and of respective outer parts laterally attached thereto. A particularly low design of the specular lamp is achieved by means of this technique.

DESCRIPTION OF THE PREFERRED EMBODIMENTS

Figure 1:
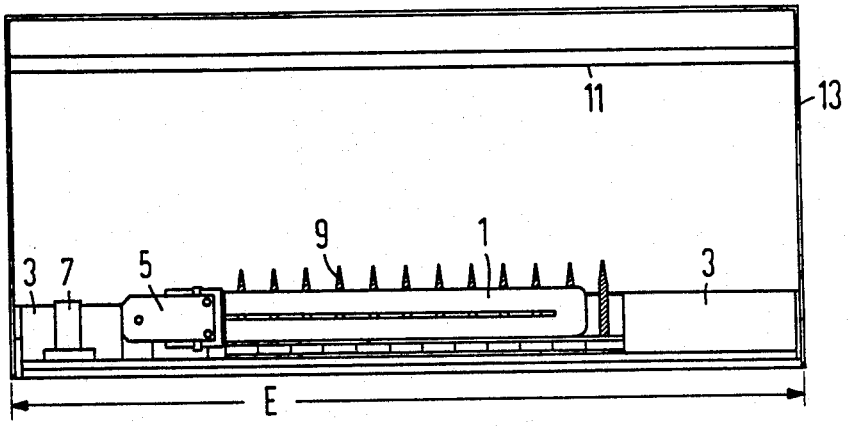
FIG. 1 is a side view of an indirect specular lamp.
Figure 2:
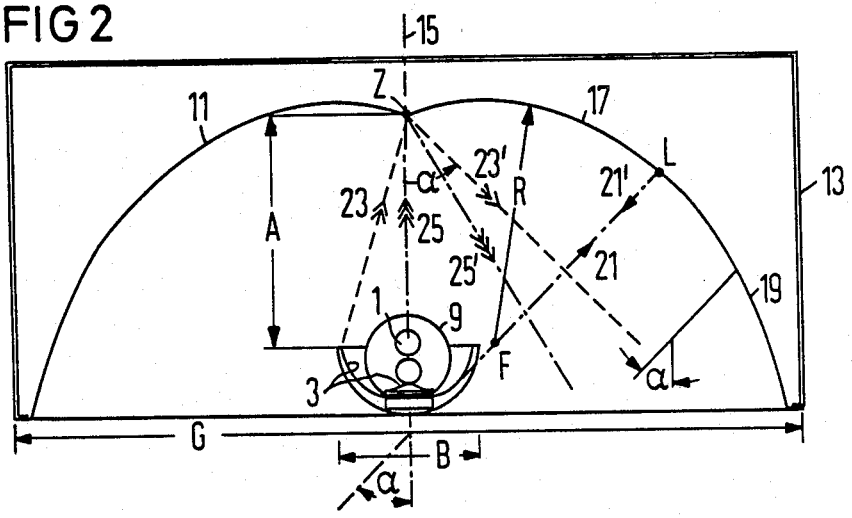
FIG. 2 is a sectional view at right angles to the view of FIG. 1.

According to FIGS. 1 and 2, a bulb 1 is arranged within a counter-reflector or back-reflector 3 fashioned as a channel. The light bulb 1 fashioned as a fluorescent tube is surrounded and completely shielded by this channel. The fluorescent tube 1 is fashioned U-shaped, i.e. comprises two illumination paths conducted parallel to one another and has its end plugged into a base 5. The base 5 is mounted at a fastening part 7 secured to the counter-reflector 3. The light bulb 1 is surrounded by circular cross-lamellae 9 arranged at a distance from one another and which have a parabolic or triangular cross section known in screen lamps.

This arrangement comprising counter-reflector 3 with fluorescent tube 1 is situated opposite a main reflector 11. This has the shape of a channel which is slightly indented in the region lying opposite the fluorescent tube 1, and is laterally secured to a housing 13.

The main reflector 11 is designed to be mirror-symmetric with respect to the center plane 15 which proceeds through the fluorescent tube 1. As seen in cross section, the main reflector 11 first has a circular arc portion 17 at both sides of the center plane 15, and this is followed by an outer part designed here as a parabolic curve portion 19. The size of each circular arc portion is defined by a limiting ray 21, 21' which is emitted from a point F at the edge or outside of the edge of the counter-reflector 3, retraces the same beam path (21') after reflection in point L of the circular arc part 17, and describes the screening angle with the vertical. To be on the safe side, this outermost point F is placed somewhat next to the counter-reflector 3 in FIG. 2. The circular arc portion 17 is thus constructed up to the point L and merges there with the parabolic curve part 19. Both arc parts 17, 19 have the same slope in point L.

The focus of the parabola on which the parabolic curve portion 19 is based in placed in the point F through which its principal axis also proceeds.

Figure 3:
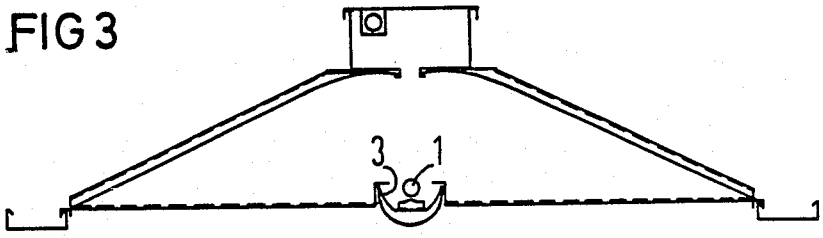
FIG. 3 is a specular lamp comprisinga partly straight design of the main reflector.

Instead of the parabolic curve portion 19, other outer portions having flat proceeding curve shapes are also possible as shown, for example, in FIG. 3. Such outer parts, however, necessarily produce a roomier structural shape which, however, can be desirable in exceptional cases. Such a case is established, for example, when the specular lamp is to be placed into a prescribed grid of, for example, 1.25 meters width as a ceiling element.

In order to achieve a compact structure, the counter-reflector 3 and the main reflector 11 have as small as possible a distance A from one another. This distance A is dependent on the required screening angle $\alpha$, and on the width of the counter-reflector 3. The smallest distance A results when a light ray 23 is emitted from the outer left edge of the counter-reflector 3 to the point A at the left edge of the right-hand circular arc portion 17, and is reflected from the latter at the screening angle $\alpha$ as light ray 23'. Given a short distance A, the prescribed value for the screening angle would be exceeded. A light ray 25 which emanates in the region between the edges of the counter-reflector 3, for example directly from the light bulb 1, is reflected by the main reflector 11 at an angle (light ray 25') that is smaller than the screening angle α. A high efficiency given observation of the secondary conditions for the screening region is achieved by this design and arrangement of the main reflector 11.

The main reflector 11 comprises a diffusely reflective inside surface which has a directivity (directionally reflected component) of between 20 and 40%. In the exemplary embodiment shown in FIGS. 1 and 2, for example, given an overall width G of the specular lamp of about G=60 cm, the directivity amounts to about 20%. Given a correspondingly larger main reflector 11 having a larger light emergence aperture, as shown later in FIG. 3, the directivity can be boosted to a value of about 40%. The main reflector 11 preferably has about six times the width of the counter-reflector 3, i.e. G=6B applies. The length E of the main reflector 11 is dependent on the light bulb 1 used, and should therefore be at least equal to the width G of the main reflector 11.

Pure or super-pure aluminum comes into consideration as the material for the main reflector 11. Alternatively, a plastic whose reflective surface is coated with pure or super-pure aluminum can also be used. In order to achieve the diffuse reflection, the surface of the main reflector 11 is either roughened, lacquered, or coated. It is also possible to provide the main reflector 11 with fine holes and to place a white layer behind these fine holes. This additionally results in good noise damping. The inside of the counter-reflector 3 is likewise fabricated of pure or super-pure aluminum. It is fashioned in a high-gloss manner, i.e. mirroring. The end faces of the reflectors 3, 11 can have glossy or diffuse surfaces.

Identical component parts are identified with the same reference characters in FIG. 3 as in FIGS. 1 and 2. Here, the two outer parts of the main reflector 11 are uncurved, i.e. are fashioned with a straight cross section. As a result, the specular lamp has large dimensions which, however, can be desirable for aesthetic or structural reasons. The descriptions to FIGS. 1 and 2 apply by analogy to the structure and functioning of the specular lamp of FIG. 3.

Although various minor changes and modifications might be proposed by those skilled in the art, it will be understood that I wish to include within the claims of the patent warranted hereon all such changes and modifications as reasonably come within my contribution to the art.

I claim as my invention:

1. An indirect specular lamp, comprising:

a channel-like shaped counter-reflector;

a light bulb arranged within said channel-like shaped counter-reflector and completely screened by it with respect to a front region to be illuminated by the lamp;

an at least partially curved main reflector arranged opposite said counter-reflector which is larger than said counter-reflector, said counter-reflector being positioned between said front region and said main reflector;

said light bulb being a fluorescent tube; and said counter-reflector being provided with cross-lamellae means at least partially surrounding said light bulb for screening said light bulb in a longitudinal direction of the light bulb.

2. A specular lamp according to claim 1 wherein a cross sectional generated surface of said main reflector has two circular arc portions joined to one another, said arc portions merging with respective outer portions.

3. A specular lamp according to claim 2 wherein the main reflector is matted and has a directivity of 20 to 40%.

4. A specular lamp according to claim 3 wherein said main reflector has a width which is approximately six times a width of said counter-reflector.

5. A specular lamp according to claim 4 wherein a length of said main reflector is at least equal to its width.

6. A specular lamp according to claim 5 wherein a length of said main reflector is between 30 and 160 cm.

7. A specular lamp according to claim 1 wherein a cross-sectional generated surface of said main reflector is mirror-symmetric relative to a center plane through said fluorescent tube and running along the longitudinal direction of said light bulb and wherein the light bulb and counter-reflector lie within the generated surface.

8. An indirect specular lamp, comprising:

a counter-reflector;

a light bulb arranged within said counter-reflector and completely screened by it with respect to a front illumination region of the lamp;

an at least partially curved main reflector arranged opposite said counter-reflector which is larger than said counter-reflector and which faces the illumination region;

said light bulb being a fluorescent tube;

said counter-reflector having a channel-like shape and being provided with cross-lamellae means surrounding said light bulb for screening said light bulb in a longitudinal direction of the light bulb and perpendicular to a direction from the counter-reflector to the illumination region; and a cross-sectional generated surface of said main reflector being mirror-symmetric relative to a center plane through said fluorescent tube and running along the longitudinal direction of said light bulb.

9. A specular lamp according to claim 8 wherein a cross-sectional generated surface of said main reflector has two circular arc portions joined to one another, said arc portions merging with respective outer portions.

10. A specular lamp according to claim 9 wherein the outer portions are straight.

11. A specular lamp according to claim 9 wherein the outer portions are parabolic.

* * * * *